United States Patent [19]

Tajima et al.

[11] Patent Number: 4,776,291

[45] Date of Patent: Oct. 11, 1988

[54] MULTI-HEAD TYPE EMBROIDERING MACHINE

[75] Inventors: Ikuo Tajima; Atsushi Ishihara; Hideo Hasegawa, all of Kasugai, Japan

[73] Assignee: Tokai Mishin Kabushiki Kaisha, Aichi, Japan

[21] Appl. No.: 1,660

[22] Filed: Jan. 8, 1987

[30] Foreign Application Priority Data

Jan. 9, 1986 [JP] Japan ..... 61-1252
Dec. 22, 1986 [JP] Japan ..... 61-303929

[51] Int. Cl.[4] ..... D05C 11/06

[52] U.S. Cl. ..... 112/98; 112/221; 112/163

[58] Field of Search ..... 112/98, 84, 78, 221, 112/163, 121.11, 121.12

[56] References Cited

U.S. PATENT DOCUMENTS 4,476,793 10/1984 Conrads et al. ..... 112/221

4,594,952 6/1986 Comploi et al. ..... 112/221 X

*Primary Examiner*—Peter Nerbun

*Attorney, Agent, or Firm*—Spensley Horn Jubas & Lubitz

[57] ABSTRACT

This multi-head type embroidering machine comprises a setting device for setting a combination of operation/non-operation of heads to be in operation and heads to be out of operation in correspondence to a desired one or more steps in an embroidering pattern stitching program. This setting device consists, for example, of a memory storing such combination data of the respective heads. If, in a process of carrying out embroidering, a step in which the operation/non-operation combination of heads should be changed has arrived, combination data set in correspondence to this step is supplied. A needle bar drive mechanism for each head is enabled or disabled independently in accordance with this combination data.

18 Claims, 15 Drawing Sheets

MULTI-HEAD TYPE EMBROIDERING MACHINE

BACKGROUND OF THE INVENTION

This invention relates to a multi-head type embroidering machine with a plurality of heads each having a needle bar drive mechanism and, more particularly, to an embroidering machine of this type capable of selecting operation or non-operation of the respective heads (i.e., driving or non-driving of a needle bar of each head) in a desired combination.

In a conventional multi-head type embroidering machine, all heads are driven together so that the same stitching pattern can be made for each head. As a result, the embroidering pattern as a whole obtainable in one embroidering frame tends to become monotonous and reduce attractiveness. Individual stitching patterns corresponding to the respective heads can be made in various ways depending upon X-Y displacement of the embroidering frame but formulation of the same pattern by all of the heads has to cause monotonousness.

SUMMARY OF THE INVENTION

It is an object of the invention to increase variations of pattern forming by selectively controlling operation or non-operation of heads thereby to realize an embroidery with various patterns free from monotonousness.

It is another object of the invention to freely change a selected combination of operation or non-operation set in correspondence to the respective heads.

It is still another object of the invention to improve the mechanism for controlling operation or non-operation of the respective heads thereby to contribute to protection of the mechanism and maintenance of safety.

The multi-head type embroidering machine achieving the above described objects of the invention is characterized in that it comprises setting means for setting a combination of heads to be in operation and heads to be out of operation in correspondence to a desired one or more steps in an embroidering process, supply means for supplying, when a step in which the operation/non-operation combination of the heads should be switched has arrived in a process of carrying the embroidering, combination data set by the setting means in correspondence to this step, and needle bar drive control means for enabling or disabling needle bar drive mechanisms for the respective heads independently from one another in accordance with the combination data supplied by this supply means.

The combination of heads to be in operation and heads to be out of operation is set as desired by the setting means in correspondence to a desired one or more steps in the embroidering process. In the process of carrying out the embroidering, when a step in which the operation/non-operation combination of the heads should be switched has arrived, combination data set by the setting means in correspondence to this step is supplied by the supply means. The needle bar drive mechanism for each hed is enabled or disabled independently in accordance with the supplied combination data. Thus, operation or non-operation of each head is automatically controlled in accordance with the previously set combination.

According to one embodiment of the invention, the needle bar drive control means comprises an electromagnetic clutch device provided in a location in which movement of the main shaft of the embroidering machine is transmitted to the needle bar drive mechanism and a clutch corresponding to a head to be enabled is engaged and a clutch corresponding to a head to be disabled is disengaged.

According to another embodiment of the inventoin, the needle bar drive control means comprises a needle bar jump mechanism for stopping a needle bar at an upper position and a jump solenoid for controlling this jump mechanism and the solenoid for each head is independently energized or deenergized in accordance with the combination data.

In another aspect of the invention, there may be provided selection means for effecting, with respect to a combination of operation and non-operation of the respective heads, selection of contents of the combination independently for each head. The needle bar drive control means enables or disables the needle bar drive mechanism in each head independently in accordance with the combination set by the setting means and the result of selection by the selection means.

Thus, operation or non-operation of each head can be individually changed as desired by the selection means. Accordingly, if, for example, it has become necessary to temporarily stop or drive a specific head in the process of the automatic embroidering, stopping and resumption of driving or driving and restopping of this head can be made with ease by the selection means. Further, in a case where the combination is changed in such a manner that operation or non-operation of only a part of heads will become opposite to the previous combination or that only a part of heads will be compulsorily stopped or driven, this can be easily achieved by changing operation or non-operation of the particular heads by the selection means while contents set by the setting means are maintained without changing.

Embodiments of the invention will now be described with reference to the accompanying drawings.

BRIEF DESCRIPTION OF THE DRAWINGS

FIGS. 13 through 17 are flow charts showing an example of a program executed by a microcomputer section in FIG. 10 in which FIG. 13 shows a main routine, FIGS. 14a–14c a main shaft stop routine in the main routine, FIGS. 15a and 15b a main shaft drive routine in the main routine, FIG. 16 an encoder clock interrupt subroutine carried out in the main shaft drive routine of FIGS. 15a and 15b, and FIG. 17 an encoder origin interrupt subroutine carried out in the main shaft drive routine of FIGS. 15a and 15b respectively.

DESCRIPTION OF PREFERRED EMBODIMENTS

Figure 1:
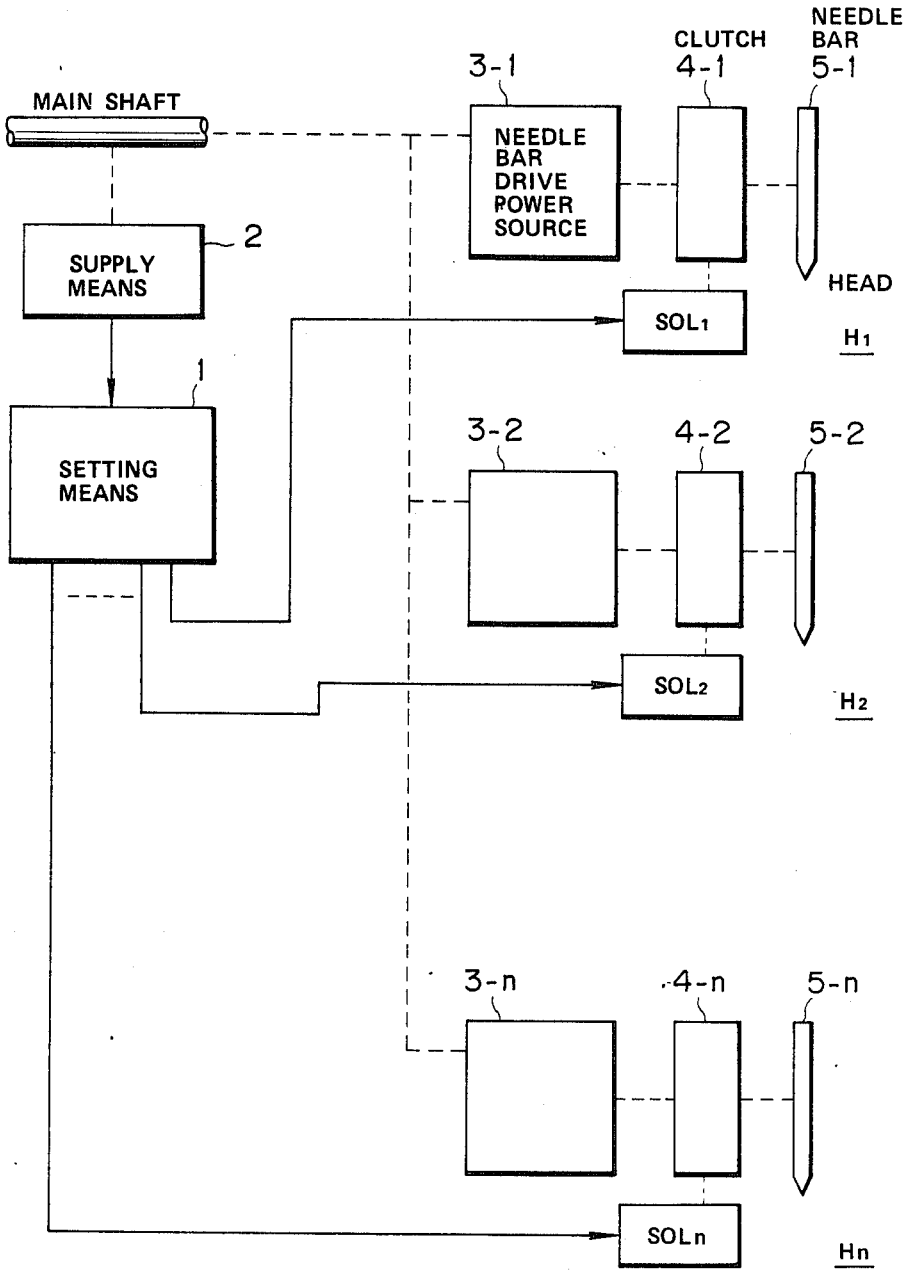
FIG. 1 is a block diagram schematically showing an essential portion of the multi-head type embroidering machine according to the invention.

FIG. 1 shows a general outline of an essential portion of an embodiment of the multi-head type embroidering machine according to the invention. Setting means 1 is provided for setting, for each predetermined operation step, a combination of heads in operation and heads out of operation among heads H1–Hn. The setting means 1 comprises set switches or the like device for manually setting, for each desired operation step, a semiconductor memory such as a RAM or ROM or an external storage medium such as a paper tape, a magnetic tape, paper card and magnetic card or a combination thereof which prestores such combinations of heads in operation and out of operation step by step. Supply means 2 is provided for supplying, when a step in which the operation/non-operation combination of the heads should be switched has arrived, combination data set by the setting means 1 in correspondence to this step. For example, the supply means 2 comprises a step counter or suitable signal generation means or the like device such as a paper tape interlocked with a main shaft of the embroidering machine. The operation step basically progresses in an interlocked relationship with the rotation of the main shaft of the machine. The "operation step" herein does not necessarily mean a step for each stitch but means some switching point in a previously programmed embroidering operation.

The machine heads H1–Hn respectively contain a needle bar drive mechanism of known construction. Namely, movements of needle bar drive power sources 3-1 through 3-n are transmitted to needle bars 5-1 through 5-n via clutches 4–1 through 4-n. The power sources 3-1 through 3-n normally consist of known movement conversion mechanisms converting the rotational motion of the main shaft of the machine to a reciprocating translational motion. Engagement and disengagement of the clutches 4-1 through 4-n are controlled by corresponding solenoids SOL1–SOLn. Electromagnetic clutch means consisting of such clutch and solenoid corresponds to needle bar drive control means. Combination data read from the setting means 1 is supplied to solenoids SOL1–SOLn corresponding to the respective heads H1–Hn so that in the clutch will remain engaged by maintaining the corresponding solenoid deenergized in a head to be in operation whereas the clutch will be disengaged by energizing the corresponding solenoid in a head to be out of operation. Thus, in accordance with the combination read from the setting means 1, the needle bar drive mechanism in each of the heads H1–Hn is independently enabled or disabled. Namely, in a head in which the clutch has been disengaged, the motion of the power source is not transmitted to the needle bar but the motion of the needle bar stops at a top dead center whereas in a head in which the clutch is engaged, the needle bar is driven.

There is a known control called "jump" in which width of one stitch is expanded by moving an embroidering frame (not shown) by a predetermined amount while the needle bar is suspended at a top dead center for a length of time for one stitch. For performing this jump, the conventional needle bar drive mechanism in each head includes a clutch and solenoid used for jumping. The conventional clutches and solenoids for jumping are utilized as the clutches 4-1 through 4-n and the solenoids SOL1–SOLn. The manner of control of these clutches 4-1 through 4-n and solenoids SOL1–SOLn are entirely different from that of the clutches and solenoids for jumping. That is, in the jump control, needle bars of all heads are suspended at a top dead center during one stitching time in the midst of pattern stitching thereby to achieve large width of stitch commonly for all heads whereas in the present invention, stitching operation itself of a specific head is suspended. If, accordingly, it becomes necessary to perform jump according to requirement by pattern data when, for example, the head H1 is out of operation (the solenoid SOL1 is energized) and the head H2 is in operation (the solenoid SOL2 is deenergized), the needle bar 5-2 can be jumped by temporarily energizing the solenoid SOL2 for the head H2. In other words, the control accoding to the invention and the conventional jump control can coexist even though common clutches and solenoids are used for both controls.

The operation step for switching the selective combination of heads can be commanded by a color change command for the needle bar or a pattern finish command. As is well known, an automatic embroidering machine can incorporate a color change command for a needle bar or pattern finish command in its program. In a step in which the color charge command has been issued, the vertical movement of the needle bar is temporarily stopped for the color changing operation of the needle bar. When a command for finishing a series of pattern has been issued, the vertical movement of the needle bar likewise is stopped. Such color change time or pattern finish time is an end point of a series of stitching operations and it is conceivable to switch the selective combination of heads at a timing of such end point of stitching operation. In this case, the supply means 2 is constructed in such a manner that the switching step advances by one step when it has been supplied with the color change command code or the finish command code. Instead of the color change command code or the finish command code, an independent combination switching command signal may be stored in the program so that the head selective combination switching step may be switched by this signal. As is well known, not a single needle bar but a plurality of the needle bars 5-1 through 5-n for the respective heads H1–Hn are provided and one of them is selected in response to a color change signal. In a case where the head selective combination step is advanced by the color change command signal, there may be a situation in which it is not desired to change the color of thread though it is desired to switch the head selective combination. Such situation can be coped with by maintaining color change information corresponding to the color change command signal as the same contents as in the previous step or as information indicating no color change.

Figure 2:
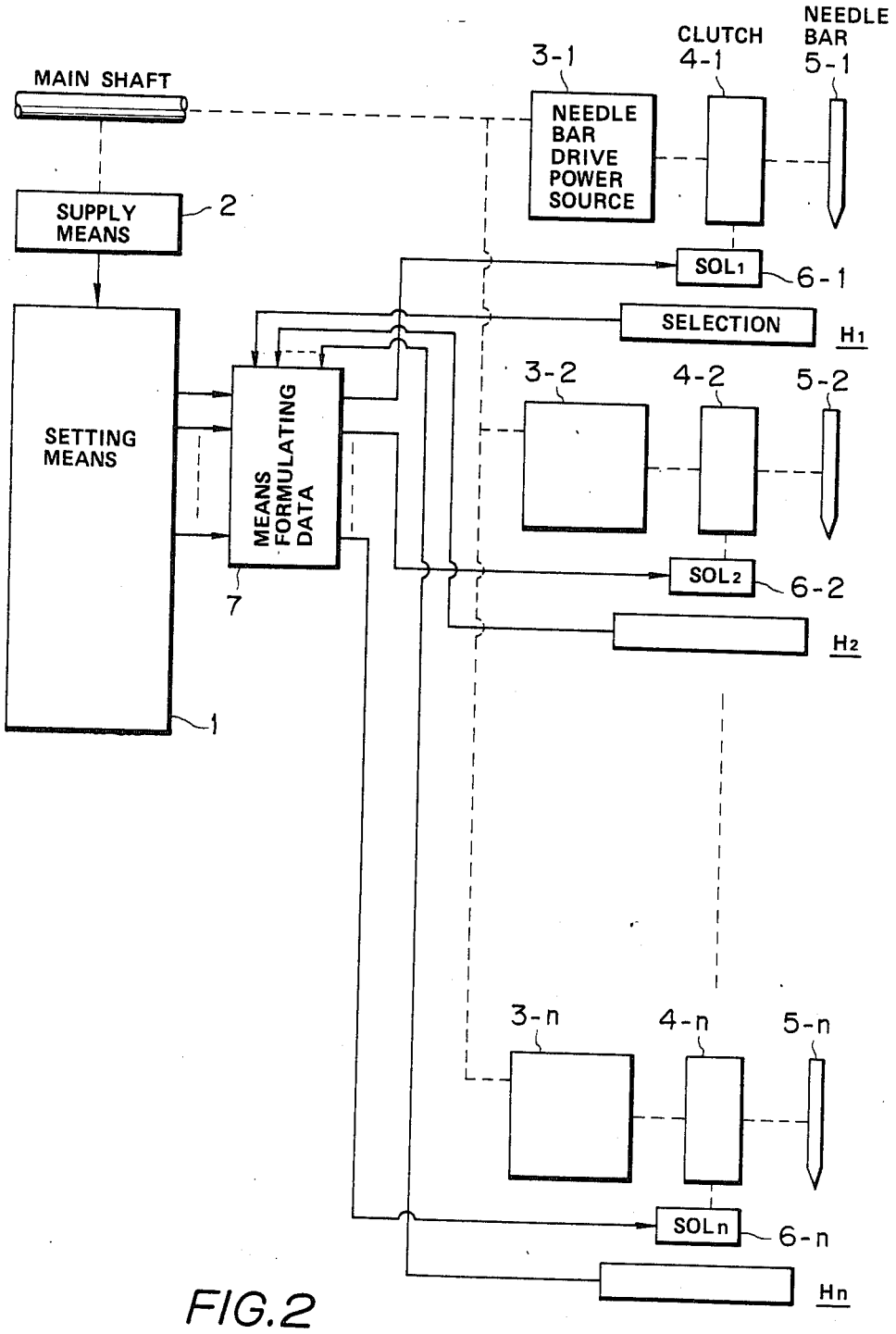
FIG. 2 is a block diagram schematically showing an essential portion of another embodiment of the invention.

FIG. 2 shows a general outline of an essential portion of another embodiment of the multi-head type embroidering machine according to the invention. In the embodiment of FIG. 2, different points from the embodiment of FIG. 1 are that drive condition selection means 6-1 through 6-n are provided in correspondence to the respective heads H1–Hn and that data formulating means 7 is provided between the setting means 1 and the solenoids SOL1–SOLn of the respective heads H1–Hn.

The drive condition selection means 6-1 through 6-n perform, for the respective heads H1–Hn, selection of operation/non-operation of the corresponding heads H1–Hn between a combination set by the setting means 1 (this is called "execution"), an operation which is inversion of the set combination (this is called "inversion"), a non-operation regardless of the contents of combination (this is called "compulsory non-operation") and an operation regardless of the contents of combination (this is called "compulsory operation"). Signals representing results of selection by the selection means 6-1 through 6-n are supplied to data formulating means 7. Combination data read from the supply means 2 is supplied to the data formulating means 7 as well. The data formulating means 7 formulates operation/non-operation data selecting operation/non-operation of the respective heads H1–Hn by changing the combination set by the setting means 1 in accordance with the results of selection by the selection means 6-1 through 6-n. The operation/non-operation data formulated by the data formulating means 7 are supplied to solenoids SOL1--SOLn corresponding to the respective heads H1–Hn. In the same manner as was previously described, in accordance with the supplied operation/non-operation data, the clutch is maintained in an engaged state by deenergizing the solenoid in a head to be in operation whereas the clutch is disengaged by energizing the solenoid in a head to be out of operation. In this manner, in accordance with the combination set by the setting means 1 and the results of selection by the selection means 6-1 through 6-n, the needle bar drive mechanisms in the respective heads H1–Hn are independently enabled or disabled. An example of operation/non-operation data of the heads H1–Hn set by the setting means 1, drive conditions selected by the selection means 6-1 through 6-n and actual operation/non-operation data provided by the data formulating means 7 to the respective heads H1–Hn is shown in the following Table 1. In the table, "1" represents "operation", "0" "non-operation", EX "execution", IN "inversion", FS "compulsory non-operation" and FO "compulsory operation", respectively.

TABLE 1

| Head number | contents of setting | condition selection | actual data |
|---|---|---|---|
| H1 | 1 | EX | 1 |
| H2 | 0 | EX | 0 |
| H3 | 0 | IN | 1 |
| H4 | 1 | FS | 0 |
| H5 | 0 | FS | 0 |
| H6 | 1 | FO | 1 |
| . | . | . | . |
| . | . | . | . |
| . | . | . | . |
| Hn | 0 | FO | 1 |

As described above, in the embodiment of FIG. 2, the contents of the operation/non-operation combination which have been once set can be changed as desired.

In the embodiment of FIG. 2, the drive condition selection means is provided for each of the heads H1–Hn. Alternatively, a single drive condition selection means may be provided commonly for all of the heads. In this case, when "inversion" has been selected, operation/non-operation of all heads H1–Hn is inverted from the contents set by the setting means 1. When "compulsory non-operation" has been selected, all heads H1–Hn are brought into an out-of-operation state altogether. When "compulsory operation" has been selected, all heads H1–Hn are brought into an operating state altogether.

Figure 3:
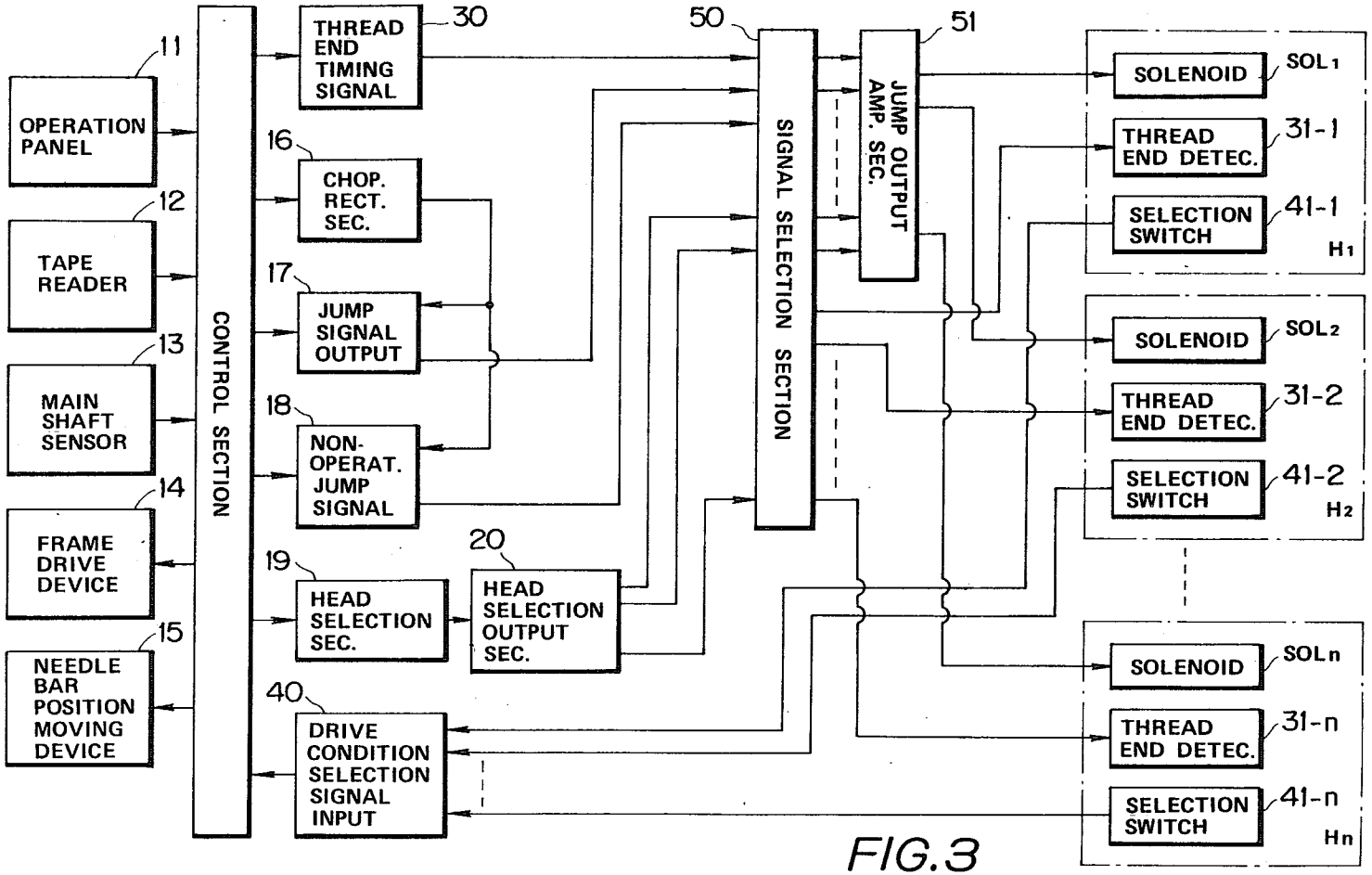
FIG. 3 is a block diagram generally showing a control system of still another embodiment of the invention.

FIG. 3 is a general control block diagram showing another embodiment of the multi-head type embroidering machine according to the invention. As in the embodiment of FIG. 2, this embodiment can also change set contents as desired. A control section 10 is a section which controls the basic operation of the embroidering machine and consists of, e.g., an electronic control circuit in the form of a microcomputer. An operation panel 11 includes operation switches and set switches for setting various data of the machine. A tape reader 12 reads an operation program and data for embroidering a desired pattern recorded on a paper tape. A main shaft sensor 13 detects a rotation angle of a main shaft of the machine. A frame drive device 14 drives an embroidering frame along the X-Y axes. A needle bar position moving device 15 moves a needle bar position of each head in accordance with color change information.

Pattern data read by the tape reader 12 is stored in a RAM provided in the control section 10. This data contains X-Y displacement data of the embroidering frame for each stitch, jump command, color change command and color change information, finish command, combination data of operation or non-operation of each head and other function data.

In this embroidering machine, drive condition selection switches 41-1 through 41-n are provided for the respective heads H1–Hn. The selection switches 41-1 through 41-n are manual switches for selecting operation/non-operation of the corresponding hands H1–Hn between "execution", "inversion", "compulsory non-operation" and "compulsory operation". Signals representing results of selection in these switches 41-1 through 41-n are applied to the control section 10 through a drive condition selection signal input section 40. In the control section 10, actual operation/non-operation data for each head is formulated by changing the set data of the operation/non-operation combination of each head read from the RAM in accordance with this input signal.

Upon starting of the embroidering machine, the control section 10 detects the progress of the stitching operation from the output of a main shaft sensor 13 and sequentially produces pattern data in the RAM in accordance with the progress of the stitching operation. The read out data is delivered out of the control section 10 at a predetermined timing in accordance with the rotation angle of the main shaft. X-Y displacement data of the embroidering frame is read out at each stitch and provided to a frame drive device 14 at a predetermined main shaft rotation angle. Color change information is read out in a step of the color change command and provided to a needle bar position moving device 15. Operation/non-operation data is read out in a step of the color change command or the finish command and provided to a head selection section 19 via a suitable buffer memory or the like device. The head selection section 19 forms an operation/non-operation selection signal corresponding to each head in response to the supplied operation/non-operation data. When the jump command has been issued, a jump timing signal is produced at a predetermined rotation angle of the main shaft and is supplied to a jump signal output section 17. A chopper rectifying section 16 produces a chopper waveform out of a signal from the control section 10 and provides this chopper waveform to the jump signal output section 17. The jump signal output section 17 produces a jump signal for a normal jump ("normal jump herein means a jump by one stitch according to the embroidery pattern) in response to the signals from the control section 10 and the chopper rectifying section 17 and supplies this jump signal to a signal selection section 50.

The control section 10 produces a non-operation timing signal and supplies this signal to a non-operation jump signal output section 18. To the non-operation jump signal output section 18 is also applied a chopper waveform from the chopper rectifying section 16 as to the output section 17. The non-operation jump signal output section 18 produces a non-operation jump signal in response to the signals from the control section 10 and the chopper rectifying section 16 and supplies this non-operation jump signal to the signal selection section 50.

The control section 10 produces also a thread end timing signal at a predetermined rotation angle for each rotation of the main shaft. This signal is supplied to a thread end timing signal output section 30. The operation/non-operation selection signal for each head provided by the head selection section 19 is supplied to the head selection output section 20 where this signal is converted to a signal of a level suitable for treating as an external signal.

The thread end timing signal produced by the output section 30 is supplied to the signal selection section 50. The head selection output section 20 converts a signal commanding operation or non-operation of each head to a signal of a level which can be outputted to the outside and supplies this signal to the signal selection section 50.

The signal selection section 50 performs selections, for each head, between supply or non-supply of the thread end timing signal and between a normal jump signal or a non-operation jump signal. That is, as to a head for which a non-operation signal has been produced by the head selection section 19, the signal selection section 50 selects and outputs non-supply of the thread end timing signal and the non-operation jump signal. As to a head for which an operation signal has been produced by the head selection section 19, the signal selection section 50 selects and outputs supply of the thread end timing signal and the normal jump signal. The thread end signal is supplied from the signal selection section 50 to thread end detectors 31-1 through 31-n provided for the respective heads. This arrangement enables examination as to whether ending of thread has taken place or not at a timing of the thread end timing signal. If ending of thread has taken place, the embroidering machine is stopped and a thread end lamp is lighted (illustration of a circuit for this purpose is omitted). Since no thread end timing is outputted in a head for which non-operation has been selected, ending of thread is not detected.

A jump output amplifier section 51 converts the normal jump signal or the non-operation jump signal to a signal of a level capable of driving a solenoid and supplies this signal to the jump solenoids SOL1–SOLn. As described previously, when the solenoids SOL-1–SOLn have been energized by the normal jump signal, the needle bar stops upwardly by one stitch whereas when the solenoids SOL1–SOLn are energized by the non-operation jump signal, the needle bar stops continuously.

An example of a mechanism for controlling operation/non-operation of a head is explained with reference to FIGS. 4 through 9.

Figure 4:
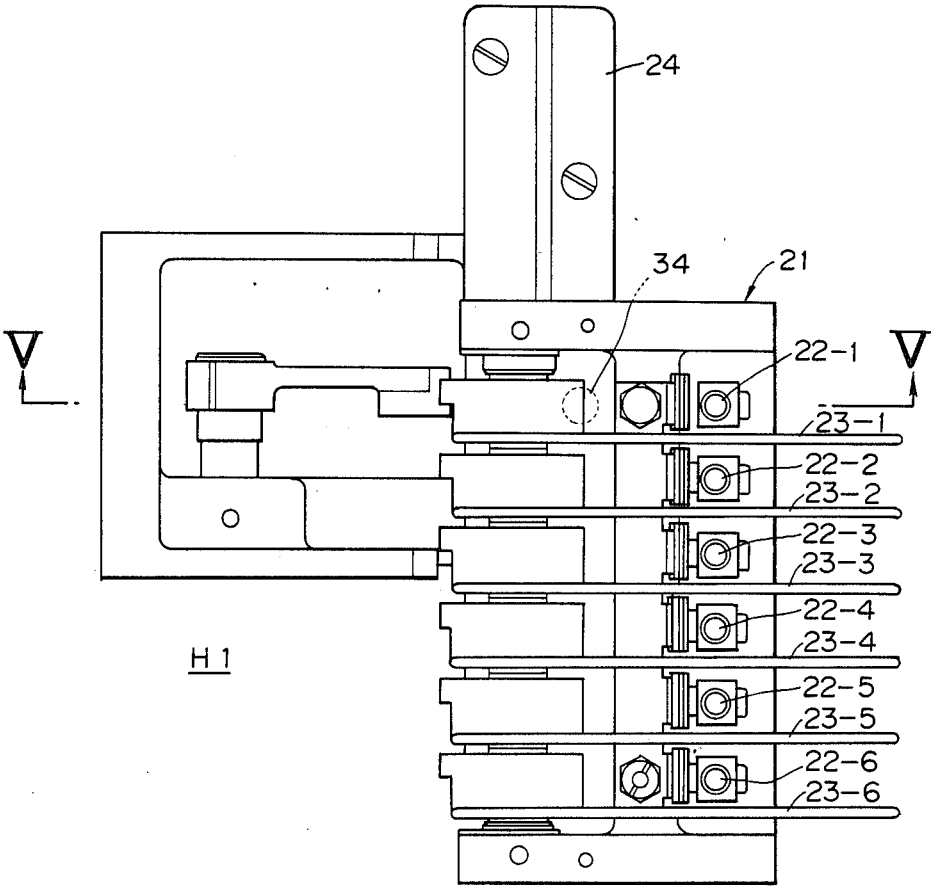
FIG. 4 is a plan view showing an example of one head in the multi-head type embroidering machine according to the invention.

FIG. 4 is a plan view of one head (e.g., H1). The head is a six-needle type head in which there are six needle bars 22-1 through 22-6 in a needle bar case 21. Reference characters 23-1 through 23-6 designate balances corresponding to the respective needle bars. The needle bar case 21 is slidable along a needle bar selection guide 24 so that a desired one needle bar is set at a drive position (a position along line V—V in the figure).

Figure 5:
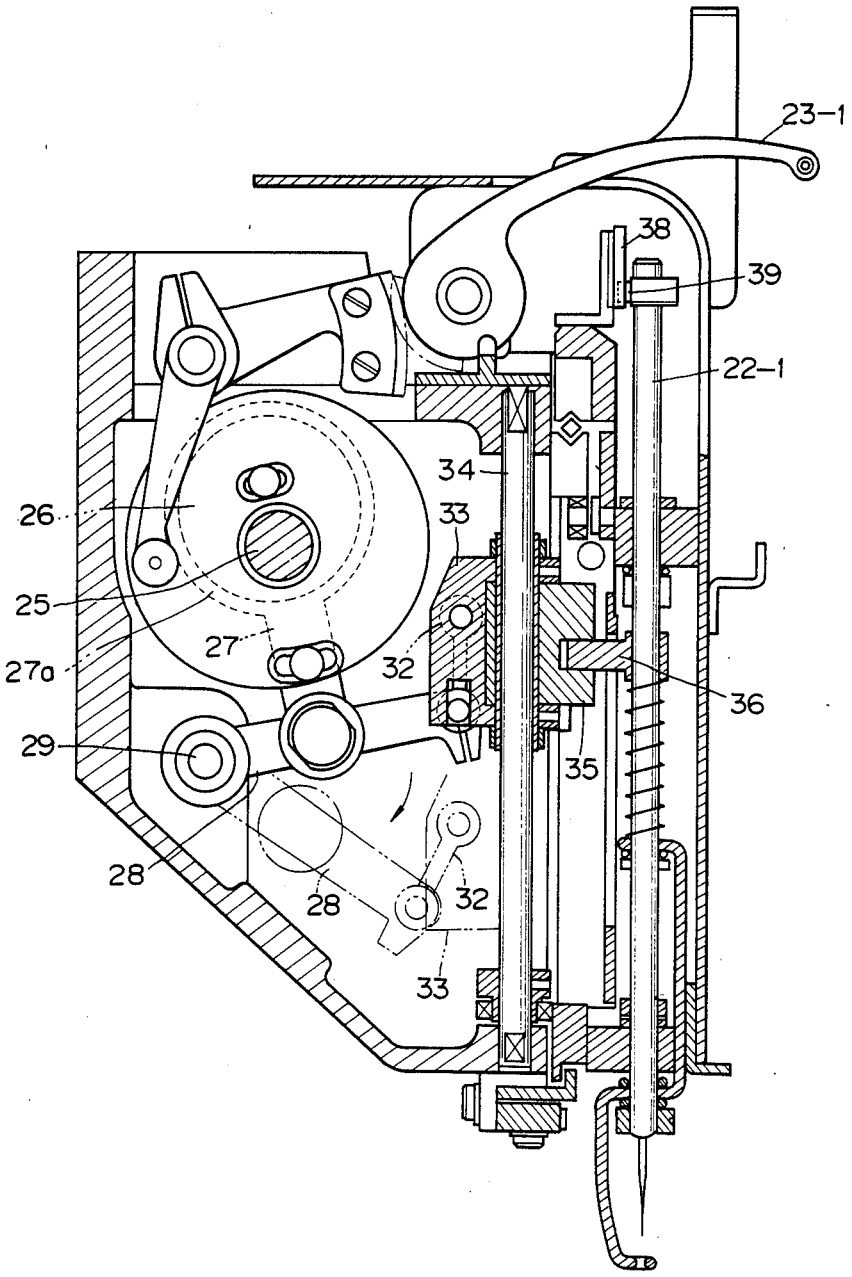
FIG. 5 is a vertical sectional view taken substantially along line V—V in FIG. 5.

FIG. 5 is a vertical sectional view taken substantially along line V—V in FIG. 4. An eccentric cam 26 is provided in such a manner that it is rotated in accordance with the rotation of the main shaft 25 of the embroidering machine. An end of an eccentric cam rod 27 constitutes a ring portion 27*a* which houses the eccentric cam 26 rotatably and the other end of the eccentric cam rod 27 is pivotally supported in the middle of a lever 28. The lever 28 is swingable about a pivot 29 and the other end the lever 28 is pivotally supported at one end of a link 32. The other end of the link 32 is pivotally supported at a predetermined position of a slider 33. The slider 33 is vertically slidable along a slide shaft 34 and has a rotary portion 35.

FIG. 5 shows a state at a top dead center. When the main shaft 25 has made just half rotation from this state, the lever 28 and the slider 33 are lowered to a position shown by a chain-and-dot line (i.e., a position corresponding to a bottom dead center). As the main shaft has made further half rotation, the lever 28 and the slider 33 return to the position corresponding to the top dead center. This is a known mechanism which, in principle, enables one rotation of the main shaft 25 to be converted to one vertical reciprocating motion of the slider 33 along the slide shaft 34 via the eccentric cam 26, rod 27, lever 28 and link 32.

Thr rotary portion 35 is vertically slidable with the slider 33 and also is rotatable about the shaft 34 independently from the slider 33. As will be described later, an engaging pin 36 fixed to a predetermined position of the needle bar 22-1 can engage in this rotary portion 35. When this pin 36 is in engagement with the rotary portion 35, the needle bar 22-1 is vertically driven by the vertical movement of the slider 33. Thus, the rotation of the main shaft 25 is transmitted as the vertical movement of the needle bar 22-1.

Figure 6:
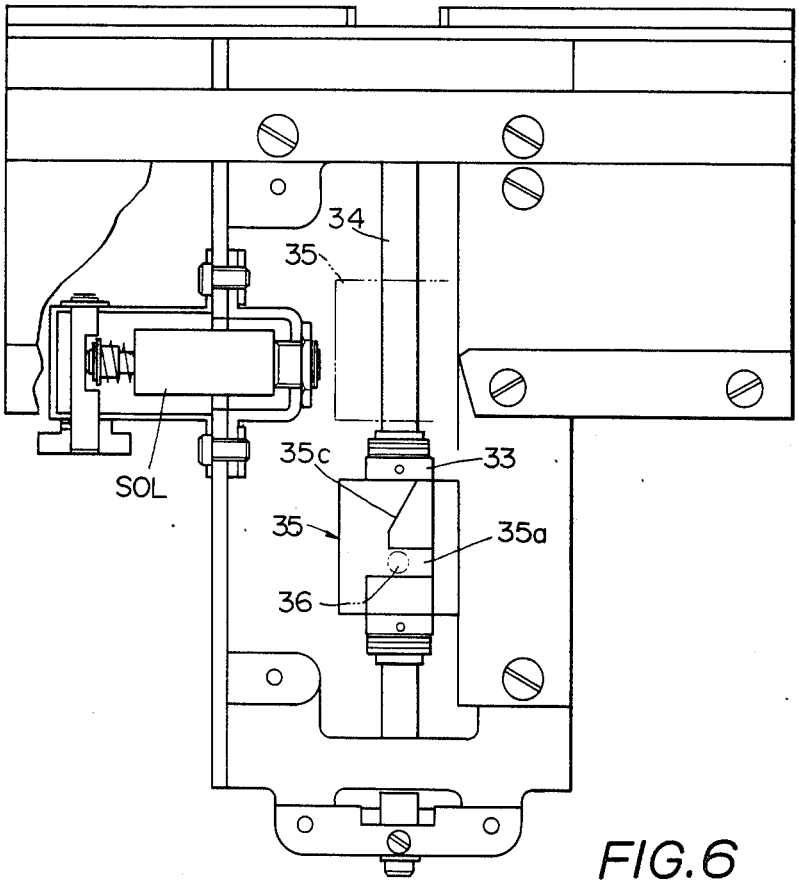
FIG. 6 is a front view of a vertical slide mechanism portion as viewed from the needle bar.

Although not shown in FIG. 5, a jump solenoid SOL is provided in association with the rotary section 35. FIG. 6 is a front view in which the rotary portion 35 is viewed from the side of the needle bar 22-1. In this case, the rotary portion 35 is shown by a solid line at a position corresponding to the bottom dead center. The position of the rotary portion 35 corresponding to the top dead center is shown by a chain-and-dot line and the jump solenoid SOL is provided corresponding to this position. The engaging pin 36 engages in a recess 35*a* formed in the rotary portion 35.

Figure 7A:
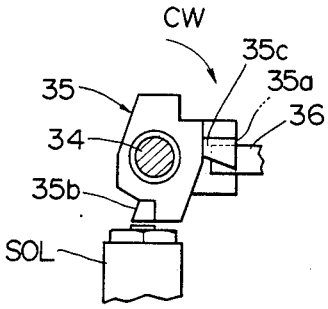
FIGS. 7*a* and 7*b* are plan views showing relationship between a rotary portion in the slider shown in FIG. 6 and a jump solenoid.
Figure 7B:
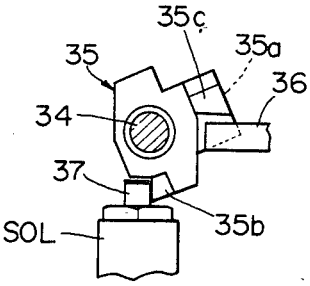
Figure 8A:
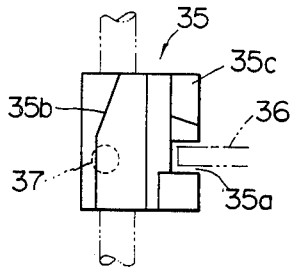
FIGS. 8*a*–8*c* are side views of the rotary portion as viewed from the side of the jump solenoid.
Figure 8B:
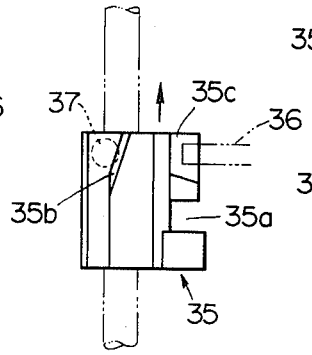
Figure 8C:
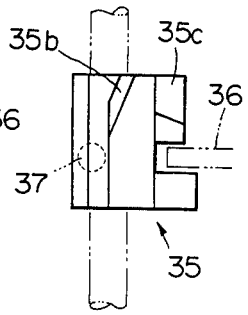

FIGS. 7(*a*) and 7(*b*) are diagrams in which the rotary portion 35 and the solenoid SOL are viewed from above. FIG. 7(*a*) shows a state in which the solenoid SOL is deenergized. In this state, the recess 35*a* of the rotary portion 35 is positioned opposite to the pin 36 of the needle bar and the pin 36 is engaged in the recess 35*a*. By means of a spring (not shown), the rotary portion 35 is constantly urged in a clockwise direction CW and the rotation of the rotary portion 35 is stopped by a stop (not shown) at the position of FIG. 7(*a*). FIG. 8(*a*) is a side view corresponding to FIG. 7(*a*).

FIG. 7(*b*) shows a state in which the solenoid SOL is energized. In this state, a plunger 37 of the solenoid SOL is projecting to bias the rotary portion 35 in a counterclockwise direction. Therefore, the pin 36 is disengaged from the recess 35*a*. FIG. 8(*c*) is a side view corresponding to FIG. 7(*b*).

Referring to FIG. 5, a catcher 38 is fixed in correspondence to the height of the upper end of the needle bar 22-1 at the top dead center. At the upper end of the needle bar 22-1 is provided a transversely extending pin 39. At the top dead center, the pin 39 engages in a holding hole (not shown) having elasticity and formed in the catcher 38 so that the needle bar 22-1 does not fall but remains at the top dead center position unless it is compulsorily pulled down.

During operation, as shown in FIG. 7(*a*), the pin 36 engages in the rotary portion 35 and this causes the needle bar caught by the catcher 38 at the top dead center to be compulsorily pulled down. During non-opration time, i.e., jump time, the pin 36 is disengaged from the rotary portion 35 as shown in FIG. 7(*b*) due to energizing of the solenoid SOL so that the needle bar caught at the top dead center does not fall but remains at the top dead center. Thus, jump of the needle bar or non-operation of the head is realized.

The side view of the rotary portion 35 as viewed from the solenoid SOL is as shown in FIG. 8 and the side view of the rotary portion 35 as viewed from the pin 36 is as shown in FIG. 6. In these figures, slant faces 35*b* and 35*c* are formed in the rotary portion 35. In a state in which the plunger 37 is projecting, the plunger 37 comes into abutting engagement with the slant face 35*b* (see FIG. 8(*b*)) during upward movement of the rotary portion 35 so that the rotary portion 35 is rotated in a counterclockwise direction along the slant face 35*b* and enters a state as shown in FIGS. 7(*b*) and 8(*c*) at the top dead center. During an initial upward movement of the rotary portion 35 immediately after the plunger 37 has been withdrawn, the pin 36 comes into abutting engagement with the slant face 35*c* (see FIG. 8(*b*)) so that the rotary portion 35 is rotated in a counterclockwise direction along the slant face 35*c*. When the pin 36 has arrived at a position of the recess 35*a*, the rotary portion 35 is moved instantly in a clockwise direction CW by force of the spring and the pin 36 engages in the recess 35*a*.

As described above, in a case where a desired head is to become out of operation, the non-operation of the head may be achieved by constantly energizing the jump solenoid SOL for this head. In this case, the eccentric cam 26 and the main shaft 25 are constantly coupled with each other and the slider 33 constantly moves vertically via the eccentric cam 26, rod 27, lever 28 and link 32 notwithstanding that the head is out of operation. Since, however, the pin 36 is disengaged from the rotary portion 35 by energizing of the solenoid SOL, the needle bar 22-1 remains at the top dead center. Thus, the head is brought into the non-operation state.

As described above, in the case of bringing the head out of operation by the control of the jump solenoid SOL, the vertical movement of the needle bar is stopped but other mechanism is moved unnecessarily. Such unnecessary movement of the other mechanism may accelerate deterioration of the mechanism and further involve danger. To cope with this problem, an exclusive electromagnetic clutch device for keeping the head in the non-operation state may be provided.

Figure 9:
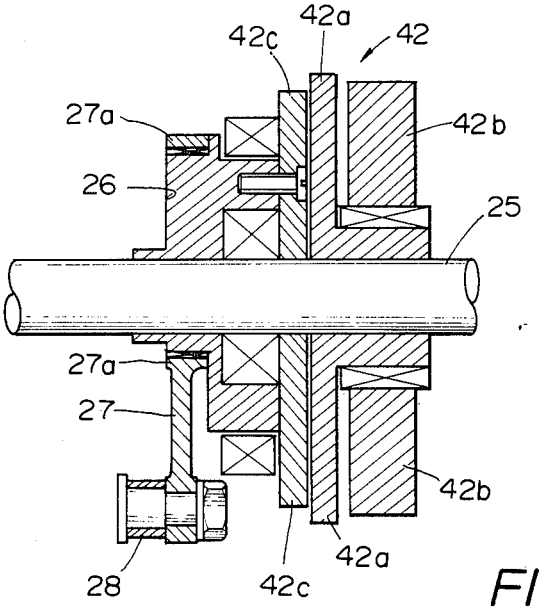
FIG. 9 is a sectional view showing an embodiment in which an electromagnetic clutch device is provided between the main shaft of the embroidering machine and an eccentric cam for controlling transmission of the rotary motion between the two component parts.

FIG. 9 shows an embodiment in which an electromagnetic clutch device 42 is provided for selectively transmitting the rotation of the main shaft 25 to the eccentric cam 26. The electromagnetic clutch device 42 comprises a rotary plate 42*a* which is fixed to the main shaft 25 and is constantly rotated with the main shaft 25, an electromagnetic coil 42*b* and a driven plate 42*c* which is coupled with the rotary plate 42*a* by energizing of the electromagnetic coil 42*b* and disengaged therefrom by deenergizing of the electromagnetic coil 42*a*. The driven plate 42*c* is connected with the eccentric cam 26. As described above, the eccentric cam 26 is rotatably engaged in the ring 27*a* provided at one end of the rod 27. The other end of the rod 27 is pivotally supported in the middle of the lever 28 as described above too (see FIG. 5). This embodiment is the same as the embodiment shown in FIGS. 5–8 except that the electromagnetic clutch device 42 is provided between the main shaft 25 and the eccentric cam 26.

The driven plate 42*c* and the eccentric cam 26 are rotatable with respect to the main shaft 25 and, when the clutch is disengaged, they are not rotated even if the main shaft 25 and the rotary 42*a* are rotating. When the clutch is engaged, the rotary plate 42*a* and the driven plate 42*c* are coupled to each other so that the rotation of the main shaft 25 is transmitted to the eccentric cam 26 through the rotary plate 42*a* and the driven plate 42*c*.

In the case where the electromagnetic clutch device 42 is porvided aside from the jump solenoid SOL as shown in FIG. 9, the jump solenoid SOL is controlled by the normal jump signal generated in accordance with stitch pattern data for each stitch while the electromagnetic clutch device 42 is controlled by the non-operation jump signal which controls operation/non-operation of the head. More specifically, in the case of "operation", rotation of the main shaft 25 is transmitted to the eccentric cam 26 with the electromagentic clutch device 42 being engaged. In the case of "non-operation", the rotation of the main shaft 25 is transmitted to the eccentric cam 26 with the electromagnetic clutch device 42 being disengaged. In the case of "non-operation", the rotation of the main shaft 25 is not transmitted to any mechanism concerning the particular head and the rod 27 and the slider 33 do not move at all. Further, the balance 23-1 and other parts which are interlocked with the movement of the eccentric cam 26 through an unillustrated mechanism do not move either. Since stopping of the basic movement of the head stops the entire function of the head, unnecessary movements of the mechanism are eliminated with resulting protection of the mechanism and maintenance of safety.

As the electromagnetic clutch device 42, a tooth-clutch is used so that engagement may be smoothly effected when relative angle between the rotary plate 42*a* and the driven plate 42*c* (i.e., between the main shaft 25 and the eccentric cam 26) is in a specified state (i.e., by causing origins of both to coincide with each other).

For preventing the driven plate 42c and the eccentric cam 26 from moving unnecessarily randomly following the movement of the main shaft 25 due to inertia or friction while the electromagnetic clutch device 42 is disengaged, a clutch with brake should preferably be used as the electromagnetic clutch device 42. That is, the driven plate 42c is stopped by applying the brake when the electromagnetic clutch device 42 is disengaged. Instead of the brake, stop means controlled by a solenoid coil or the like device may be provided in association with the eccentric cam 26 or the driven plate 42c so that the stop means is actuated when the electromagnetic clutch device 42 is disengaged so as to stop the eccentric cam 26 or the driven plate 42c.

Referring now to FIGS. 10 through 17, a more specific embodiment of the control system of the multihead type embroidering machine according to the invention will be described.

Figure 10:
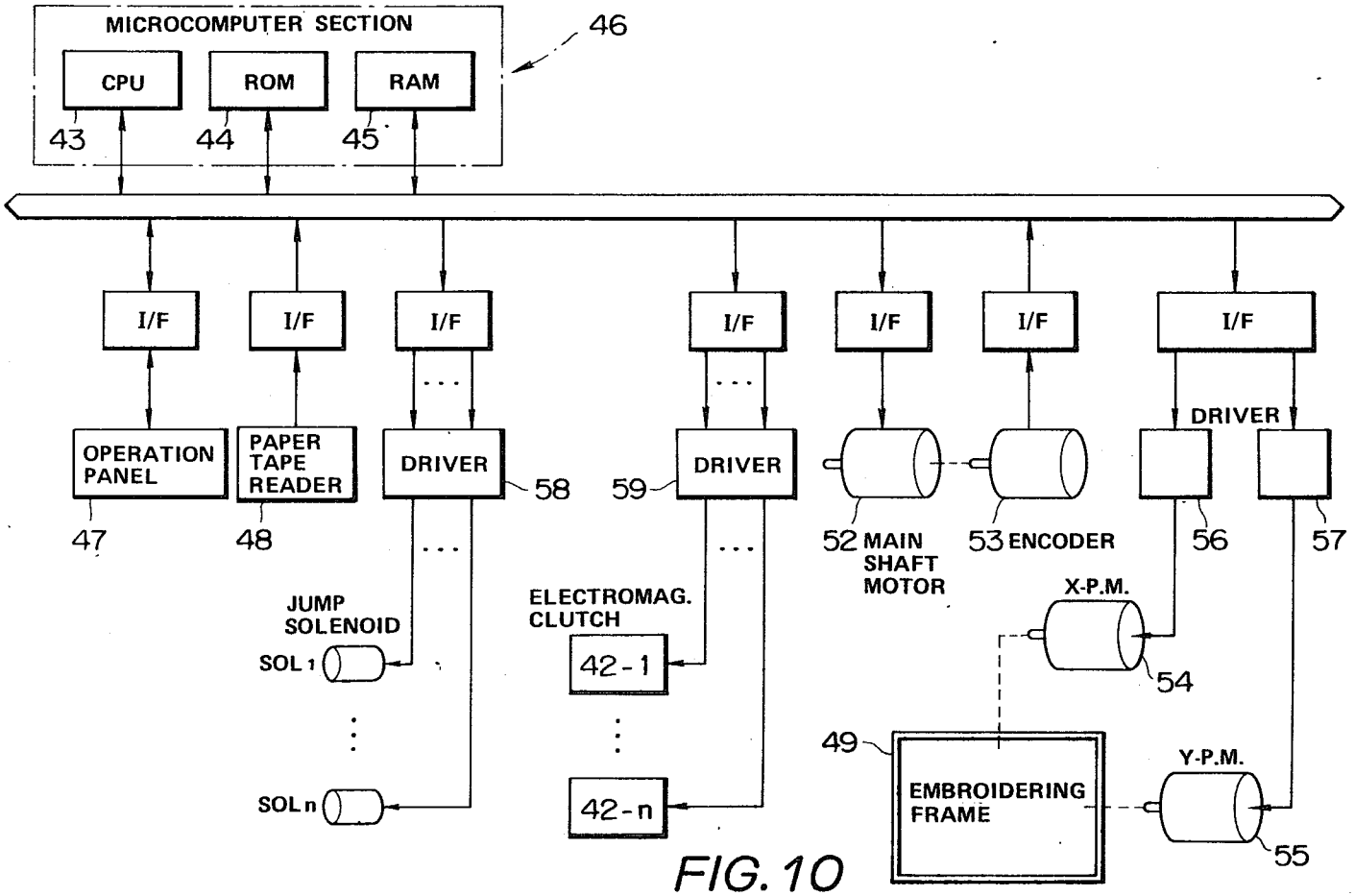
FIG. 10 is a block diagram of a hardware construction showing a specific example of the control system of the multi-head type embroidering machine according to the invention.

FIG. 10 is a diagram showing a hardware construction of the control system of this embodiment. In this embodiment, electromagnetic clutch devices 42-1 through 42-n are provided for respective heads and operation/non-operation of the respective heads is controlled by these electromagnetic clutch devices 42-1 through 42-n. Jump solenoids SOL1–SOLn are also provided for the respective heads and they are used for normal jump control.

The entire operation of this embroidering machine is controlled by a microcomputer section 46 comprising a CPU 43, a ROM 44 and a data and working RAM 45. An operation panel 47 comprises various operation switches. A paper tape reader 48 reads out tape data recorded on a paper tape (i.e., X-Y data indicating the displacement of an embroidering frame 49, function data indicating respective operations of the embroidering machine such as color change and main shaft stop and head selection setting data concerning the combination of operation/non-operation of the respective heads).

A main shaft motor 52 rotates the main shaft 25 of this embroidering machine (FIGS. 5 and 9). A rotary encoder 53 detects the rotation angle of the motor 52. An X-axis pulse motor 54 moves the embroidering frame 49 in the X-axis direction and a Y-axis pulse motor 55 moves the embroidering frame 49 in the Y-axis direction. The pulse motors 54 and 55 are respectively driven by an X-axis pulse motor driver 56 and a Y-axis pulse motor driver 57. The drivers 58 and 59 are respectively drivers for driving the jump solenoids SOL1–SOLn and the electromagnetic clutches 42-1 through 42-n. Signals are transmitted between the respective devices and the microcomputer section 46 through an interface I/F.

Figure 11:
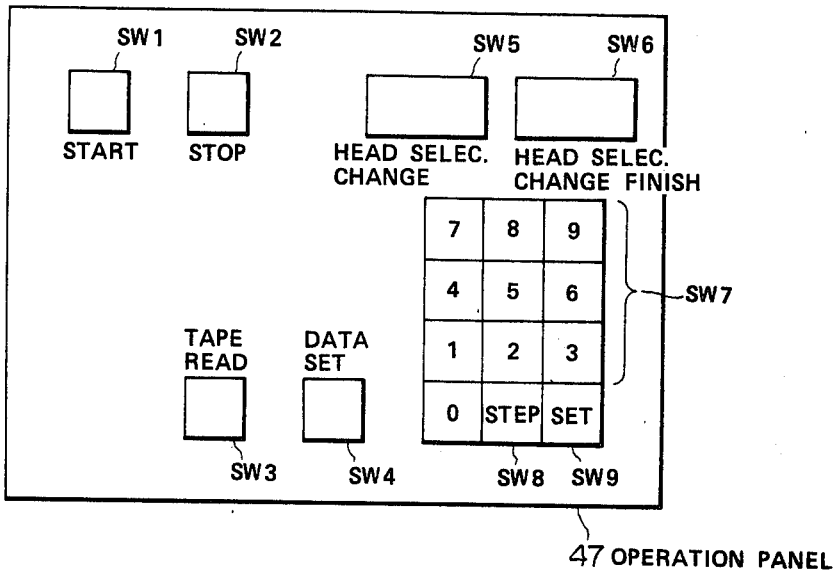
FIG. 11 is a plan view showing an example of an operation panel of FIG. 10.

An example of switches provided on the operation panel 47 are as shown in FIG. 11. A start switch SW1 is a switch for rotating the main shaft of the embroidering machine. A stop switch SW2 is a switch for stopping the main shaft. A tape read switch SW3 is a switch for enabling reading out of tape data. A data set switch SW4 is a switch for final setting of various data before starting the embroidering operation.

A head selection change switch SW5 is a switch operated when contents of the head selection setting data concerning the combination of operation/non-operation for each head are to be changed. Specific contents of the change are selected by operating a ten key switch SW7. A head selection change finish switch SW6 is operated when this changing operation has been completed. The ten key switch SW7 is a switch for inputting various numerical data. A step switch SW8 is a switch operated when the work is to be advanced to a next step in setting of various data. A set switch SW9 is a switch operated when numerical data inputted by the ten key switch SW7 is to be registered.

Figure 12:
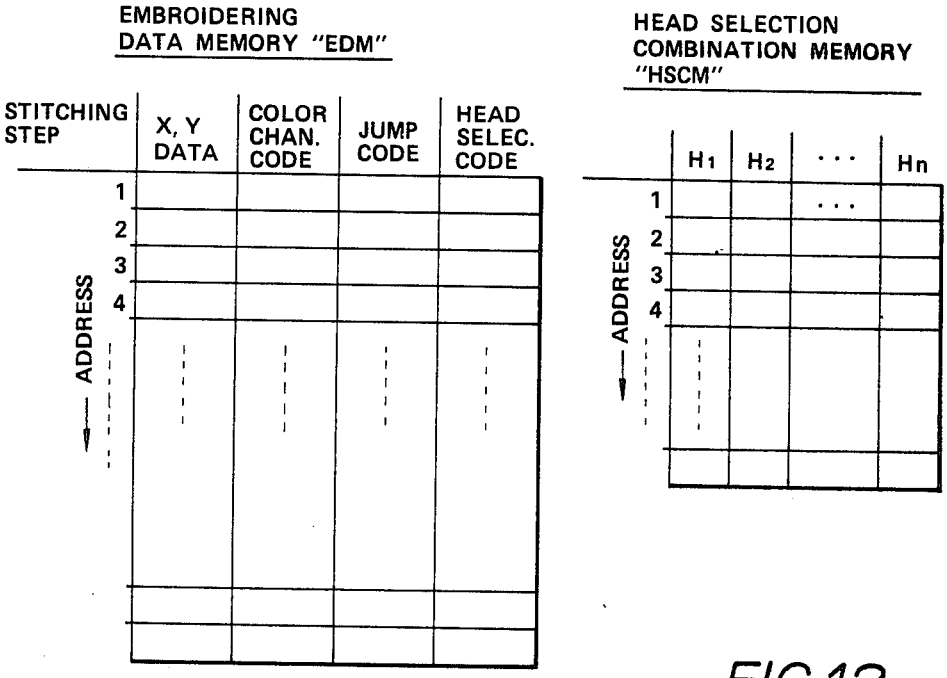
FIG. 12 is a diagram showing an example of a memory map of an embroidery data memory and a head selection combination memory in a data and working RAM in FIG. 10.

FIG. 12 shows an example of a memory map of an embroidering data memory EDM and a head selection combination memory HSCM provided in the RAM 48. The embroidering data memory EDM stores embroidering data (X-Y data and function data) in each stitching step for one stitch. The address is provided in the order of the stitching steps and various data in one stitching step, including X-Y data of the embroidering frame, color change code, jump code and head selection code are stored in one address. The head selection code is stored in a stitching step in which operation/non-operation of the head is to be switched. That is, in a stitching step in which this head selection code is not stored, switching of operation/non-operation is not performed whereas in a stitching step in which the head selection code is stored, this switching is performed. The jump code is stored in correspondence to a stitching step in which the normal jump operation, i.e., jump for producing a long stitch, is made.

The head selection combination memory HSCM stores operation/non-operation data for each head in each head selection step. The address is provided in the order of the head selection step. The operation/non-operation data for each of the heads H1–Hn (e.g., "1" represents operation and "0" non-operation) is stored in one address. The head selection step is a stitching step corresponding to the head selection code. The head selection step is switched in accordance with this head selection code. For example, the head selection step is initially set to 1 when the embroidering is started. Then, when a first head selection code has been supplied in a predetermined stitching step, e.g., the stitching step "22", the head selection step becomes "2". Further, when a second head selection code has been supplied in another predetermined stitching step, e.g., the stitching step "67", the head selection step becomes "3". The operation/non-operation data stored in this memory HSCM hereinafter is referred to as "head selection combination data" which will be abbreviated as HSCD.

The data to be stored in the data memory EDM and the head selection combination memory HSCM are prestored in paper tape and data read from this paper tape is transferred to the memories EDM and HSCM and stored therein. The contents of the head selection combination memory HSCM are set to preset contents but such contents can be changed by operation of the head selection change switch SW5.

Nextly, referring to the flow charts of FIG. 13 and subsequent figures, the embroidering operation carried out by the embroidering machine of FIG. 10 under the control of the microcomputer section 46 will be described.

Figures 13, 14A:
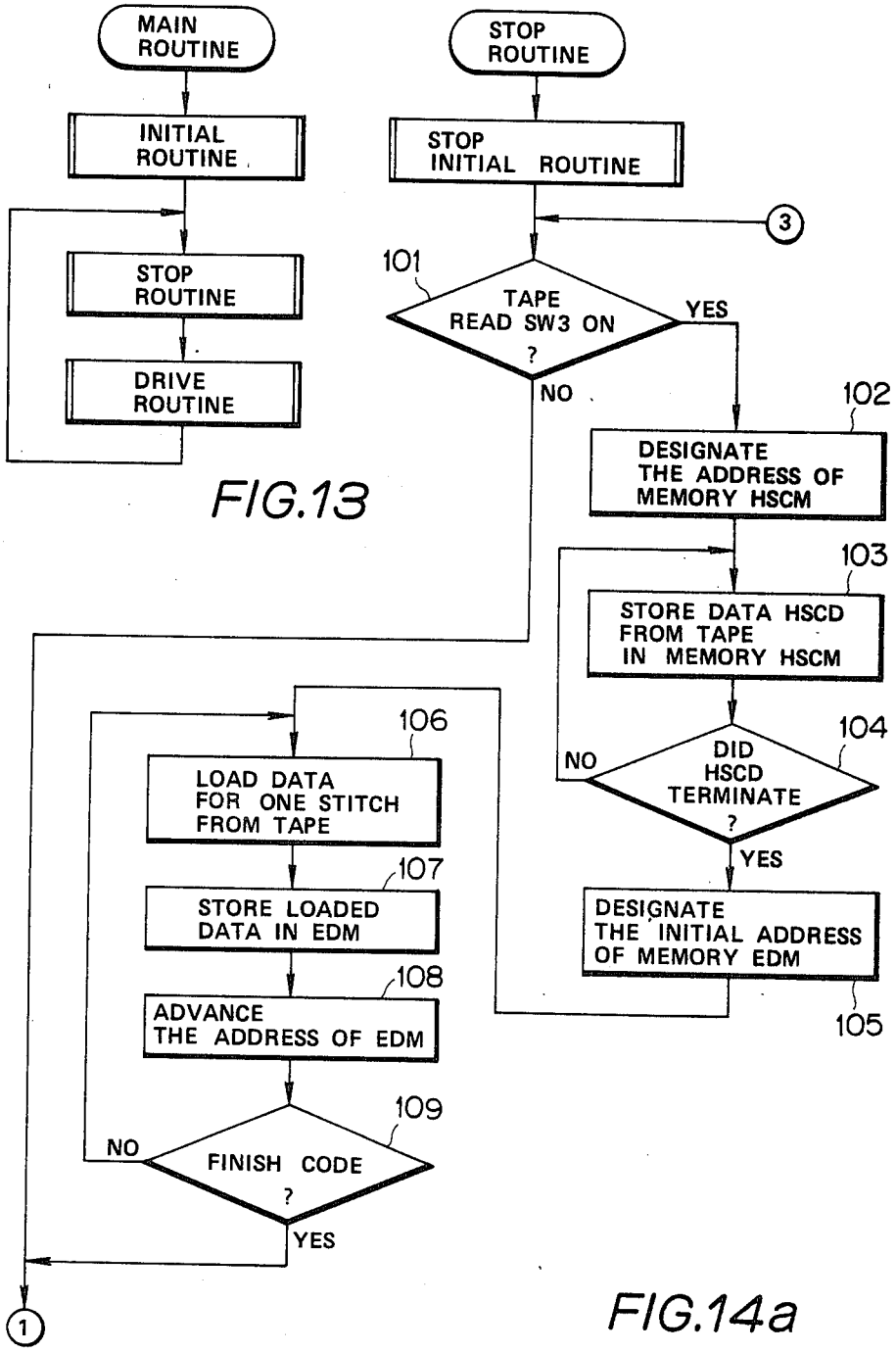
Figure 14B:
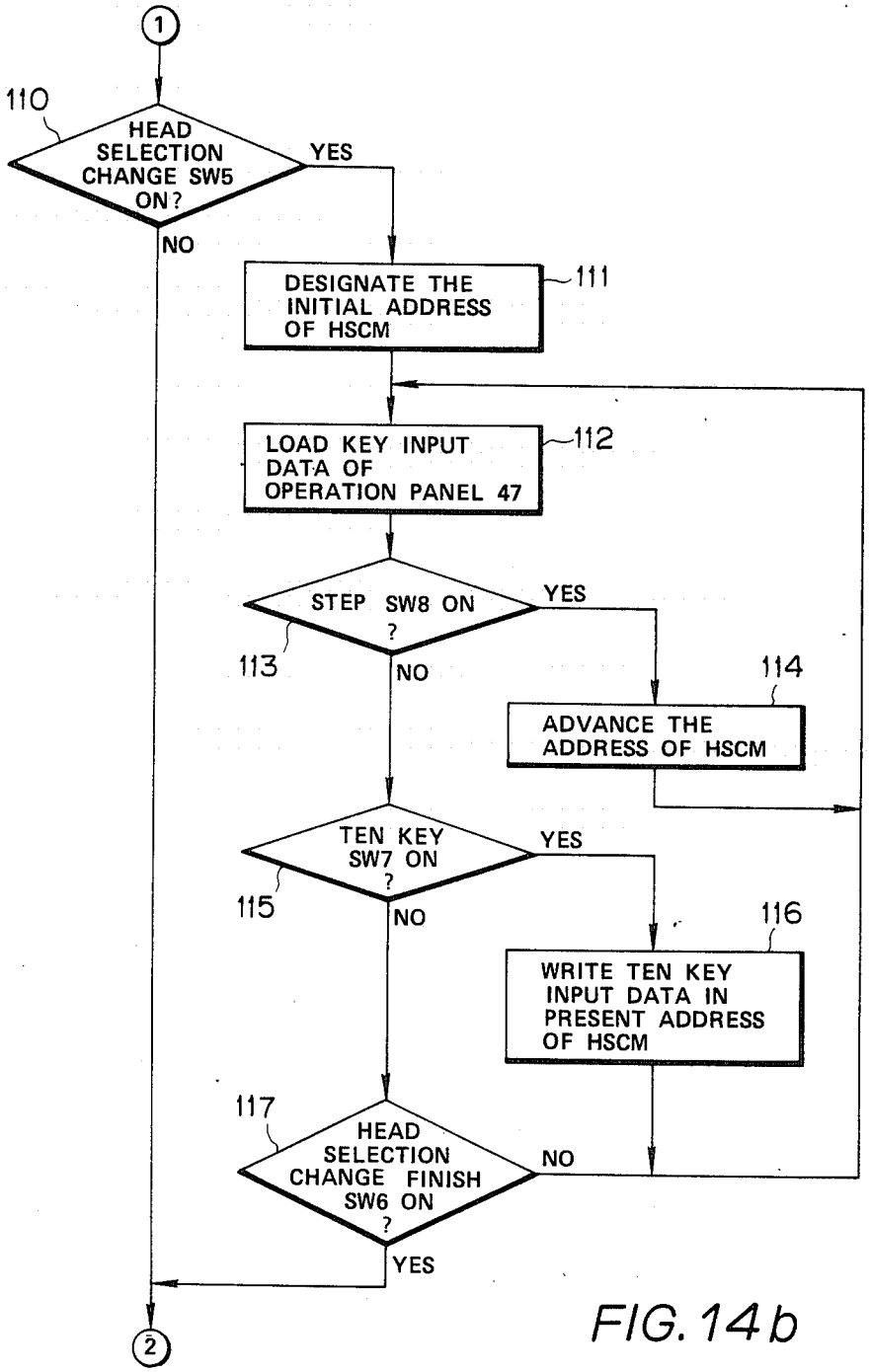
Figure 14C:
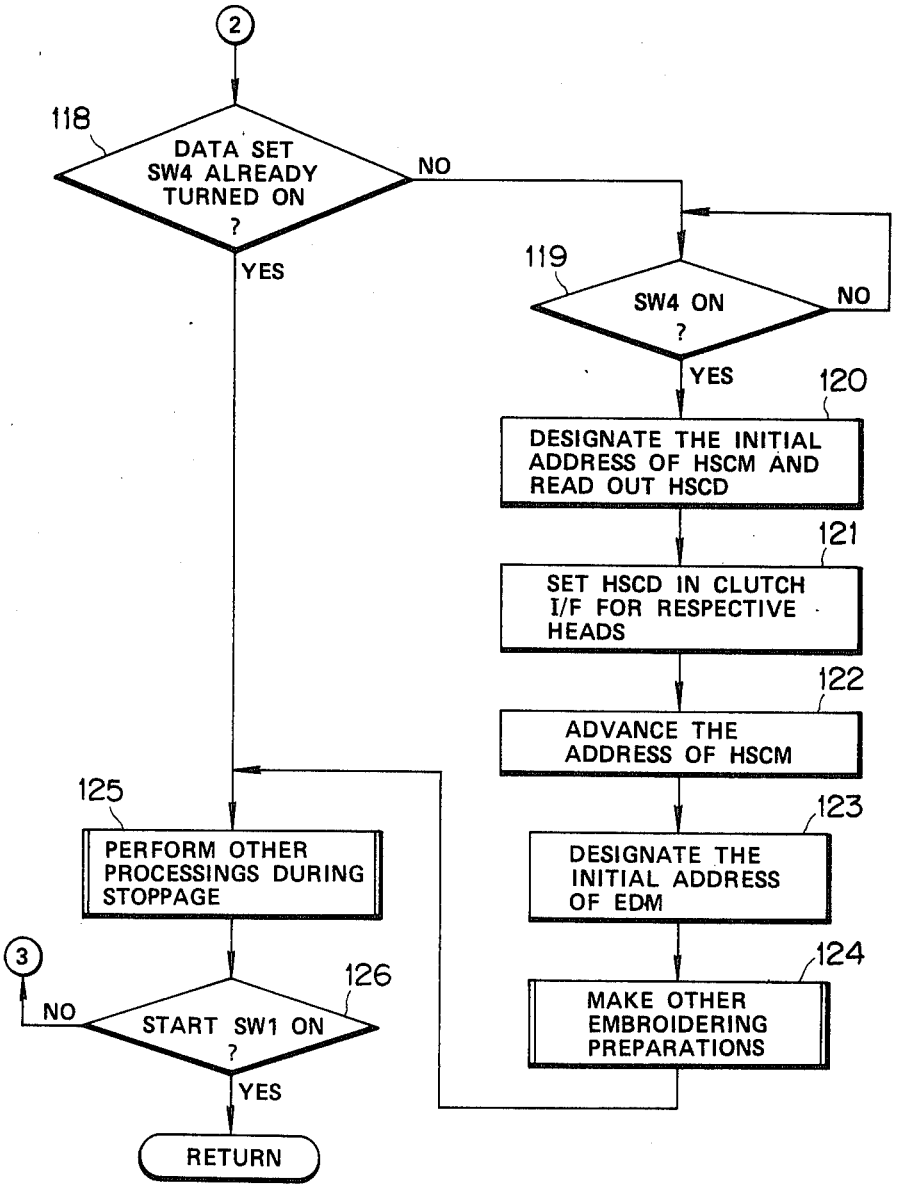

Upon switching on of the embroidering machine, as shown in FIG. 13, the processing proceeds to an embroidering machine main shaft stop routine via a predetermined initial routine. In the shaft stop routine, as shown in FIG. 14, storage in the data and working RAM 48 is cleared in a stop initial routine. Nextly, whether the tape read switch SW3 of the operation panel 47 has been turned on or not is examined (step 101). If the switch SW3 is a turned on, data recorded on the paper tape is read out by the paper tape reader 48 and the read out data is stored in the above described head selection combination memory HSCM and the embroidering data memory EDM (steps 102–109).

Nextly, whether the head selection change switch SW5 has been turned on or not is examined (step 110) and, if the switch SW5 is turned on, the contents of the head selection combination memory HSCM are changed by processings in steps 111–117. In step 111, the address of the memory HSCM is designated to the initial address. In step 112, data (key input data) of a switch operated on the operation panel 47 is loaded. If the step switch SW8 is operated, the address of the memory HSCH is advanced to return to step 112 (steps 113, 114). If the ten key switch SW7 has been turned on, data corresponding to the operation of the ten key switch SW7 is written in the presently designated address of the memory HSCM and the processing returns to step 112 (steps 115, 116). When the head selection change finish switch SW6 has been turned on, this processing is finished and the processing advances to step 118. Thus, by operation of the step switch SW8 and the ten key switch SW7, operation/non-operation data for a desired head in a desired head selection step in the memory HSCM is changed.

In step 118, whether the data set switch SW4 has already been turned on or not is examined. If it has not been turned on yet, the processing proceeds to step 119 in which whether the switch SW4 has been turned on or not is examined. If the switch SW4 is turned on, the address of the memory HSCM is set to the initial address to read out operation/non-operation data HSCD for each head in the initial head selection step (step 120). In step 121, a clutch-on signal or a clutch-off signal is supplied to interface I/F of the respective electromagnetic clutces 42-1 through 42-n of the respective heads in accordance with the data HSCD. The interface I/F holds this signal and supplies it to the driver 59 to set the respective clutches 42-1 through 42-n to an on-state or an off-state. Thus, the respective heads are set to a operation or non-operation state.

Nextly, in step 122, the address of the memory HSCM is advanced by one step. Then, in step 123, the address of the data memory EDM is set to the initial address to prepare for reading of the embroidering data in the first stitching step. In step 124, other embroidering preparations are made.

In step 125, other processings during stoppage of the embroidering machine are performed. In step 126, whether the start switch SW1 has been turned on or not is examined. If the answer is NO, the processing returns to step 101. If the answer is YES, the processing returns to the main routine.

In the main routine, main shaft drive routine is executed in accordance with turning on of the start switch SW1.

Figure 15A:
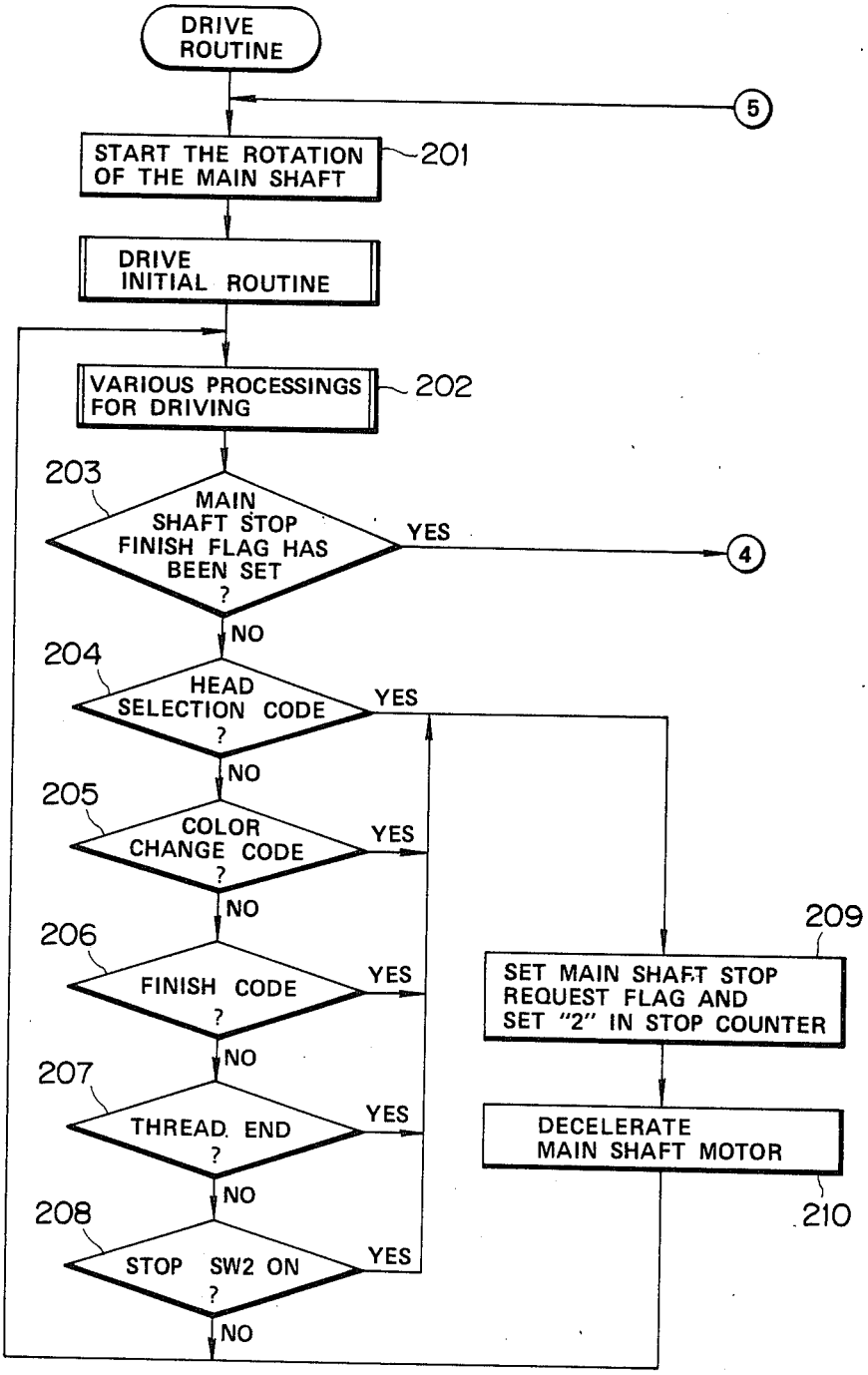
Figure 15B:
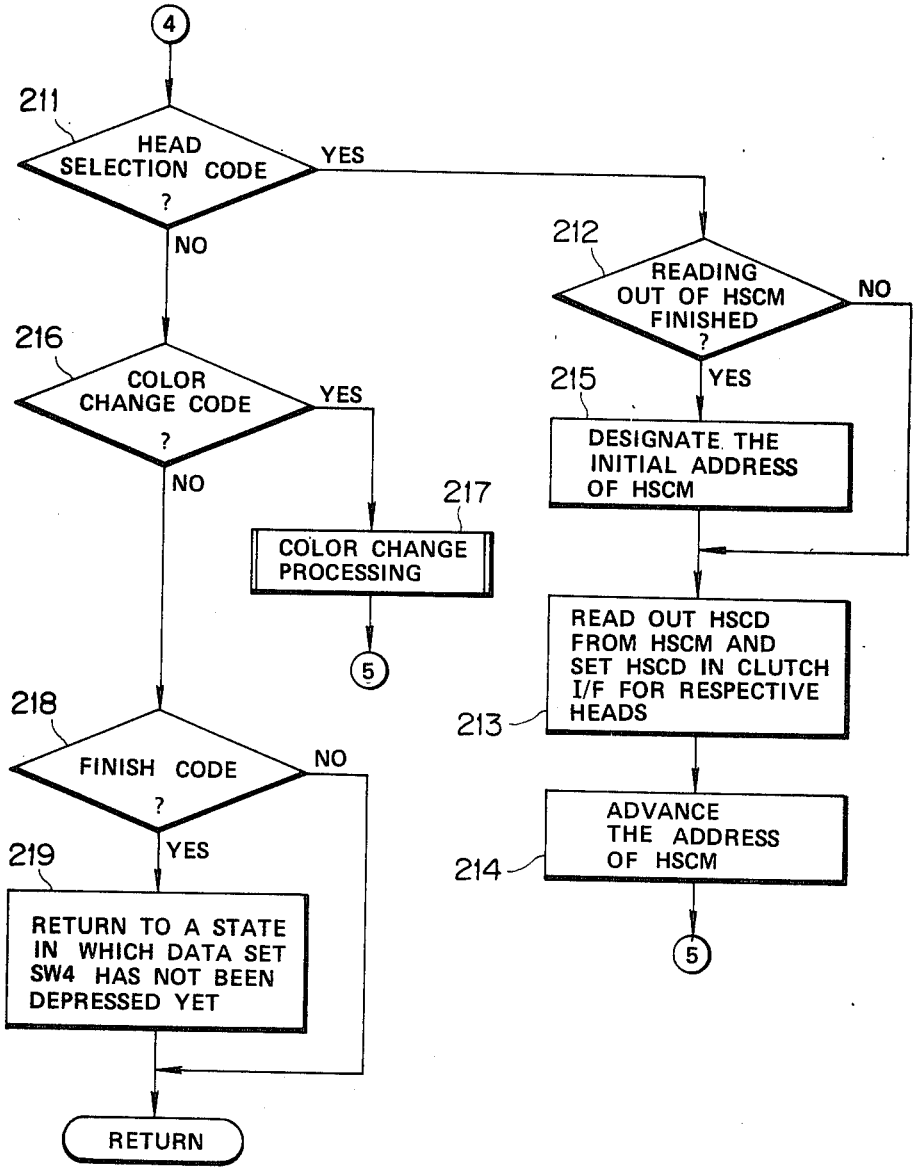

In main shaft drive routine, as shown in FIG. 15, a main shaft motor 52 is driven to start the rotation of the main shaft (step 201) and thereafter processing of a predetermined drive initial routine is executed. Nextly, various processings for driving of the embroidering machine are performed (step 202). Then, whether a main shaft stop finish flag has been set or not is examined (step 203). If the answer is NO, whether the head selection code has been provided in correspondence to the currently executed stitching step or not (step 204), whether the color change code indicating color change has been provided or not (step 205), whether the finish code has been provided or not (step 206), whether thread end has been detected or not (step 207) and whether the stop switch SW2 has been turned on or not (step 208) are respectively examined. If steps 203 through 208 are all NO, the processing returns to step 202. If any of steps 204 through 208 is YES, a main shaft stop request flag is set and also a stop counter is set to, e.g., "2" (step 209) and the main shaft motor 52 is decelerated (step 210).

Figures 16, 17:
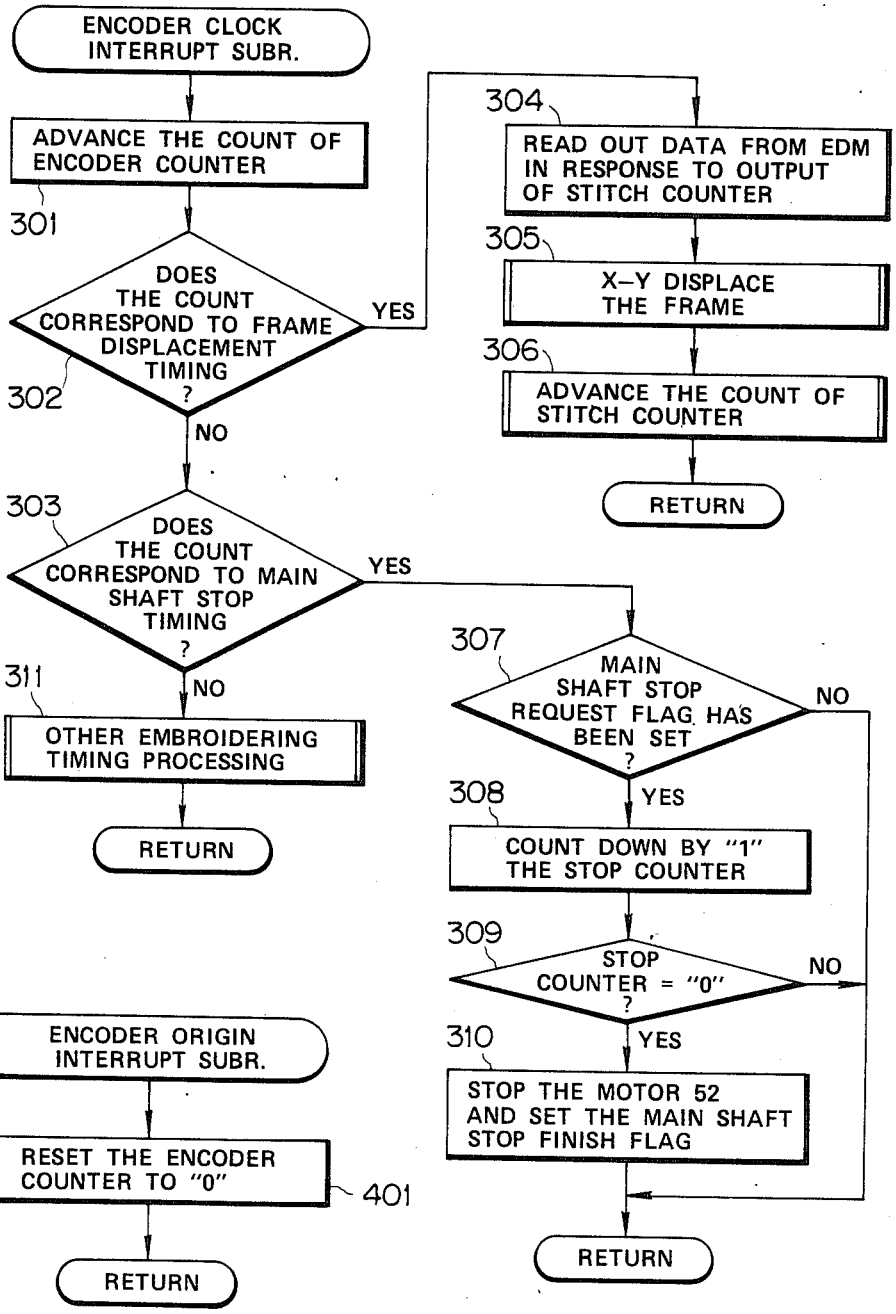

If a clock signal is supplied from a rotary encoder 53 during processing of this main shaft drive routine, the processing is interrupted each time such clock signal is received and the processing proceeds to an encoder clock interrupt subroutine as shown in FIG. 16.

In the encoder clock interrupt subroutine, an encoder counter is counted up by one (step 301) and thereafter which processing timing the count corresponds to is sequentially examined (steps 302, 303) and processings corresponding to the respective timings are carried out. At an embroidering frame displacement timing, X-Y data and function data corresponding to the current stitching step are read from the embroidering data memory EDM in response to the output of a stitch counter (step 304). The embroidering frame 47 is X-Y displaced in response to this X-Y data (step 305) and then the stitch counter is advanced to the next stitching step (step 306). At a main shaft stop timing, whether the main shaft stop request flag has been set or not is examined (step 307). If the answer is YES, the stop counter is counted down by one and whether the count has become zero or not is examined (steps 308, 309). If the count has become zero, the main shaft motor 52 is stopped and the main shaft stop finish flag is set (step 310).

A flow of a processing for the normal jump control which is not shown is included in other embroidering timing processing (step 311).

If an origin signal has been provided from the rotary encoder 53 during the processing of the main shaft drive routine, the processing is interrupted each time such origin signal has been received and the processing proceeds to an encoder origin interrupt subroutine as shown in FIG. 17 in which the encoder counter is reset (step 401).

In the drive routine shown in FIG. 15, upon confirmation that the main shaft stop finish signal has been set in step 203, the processing proceeds to step 211 in which whether the head selection code has been supplied or not is examined. If the head selection code has been supplied, the processing proceeds to step 213 on condition that reading out of the data stored in the head selection combination memory HSCM has not been finished (NO in step 212). In step 213, the data HSCD for the respective heads are read from a present designated address of the memory HSCM and the data HSCD is set at the interface I/F of a clutch driver 59. In next step 214, the designated address of the memory HSCM is advanced. Thereafter, the processing returns to the initial step 201 of the drive routine. In this manner, switching between clutch-on and clutch-off is effected. When the reading from the memory HSCM has been finished, the processing proceeds from YES in step 212 to step 215 in which the designated address of the memory HSCM is restored to the initial address (head selection step 1).

If the color change code has been supplied, a predetermined color change processing is executed and then the processing returns to step 201 (steps 216, 217). If the finish code has been supplied, the processing which returns to a state in which the data set switch SW4 has not been depressed yet is performed (steps 218, 219).

By operation of the head selection change switch SW5, ten key switch SW7 and step switch SW8, desired head selection combination data may be set in the head selection combination memory HSCM and the contents of this memory HSCM may be stored in an external memory (e.g., stored on a paper tape by means of a paper tape punching device).

The control system of the embroidering machine may be connected to a communication network for general purpose so that operation/non-operation data for the respective heads is supplied from a computer system located in a remote place.

According to the invention, combinations of heads to be in operation and those to be out of operation is programmed, these combinations are read out as the operation step advances and operation/non-operation of the respective heads is automatically selected in accordance with the read out combination. Accordingly, kinds and variations of embroidery patterns which can be produced in the automatic embroidering can be increased.

Further, according to the invention, a set combination of operation/non-operation of the respective heads can be individually changed as desired. If, therefore, it becomes necessary to temporarily stops a head which is in operation or operate a head which is out of operation, stopping and subsequent resumption of operation or operation and subsequent stopping of such head can be carried out with ease. Further, if it is desired to reestablish a combination of operation/non-operation of a part of heads so that the combination will become opposite to the previous combination or reestablish a combination of operation/non-operation of a part of heads so that these heads only are held in the operation state or non/operation state, such reestablishing of combination can be carried out with ease with resulting simplification in the setting of combination.

Further, according to the invention, the clutch device is provided between the needle bar drive mechanism for each head and the main shaft of the embroidering machine and the entire needle bar drive mechanism becomes out of operation as to a head which is to become out of operation by disengaging this clutch, waste operation of the mechanism during non-operation of the head is eliminated with resulting protection of the mechanism and maintenance of safety.

What is claimed is:

1. A multi-head type embroidering machine comprising:

a plurality of embroidering heads, each head having a needle bar drive mechanism;

a rotary main shaft for providing a driving force to operate the needle bar drive mechanisms;

setting means for setting a combination of heads to be in operation and heads to be out of operation in correspondence to a desired one or more steps in an embroidering process;

supply means for supplying, when a step in which the operation/non-operation combination of said heads should be switched has arrived in a process of carrying out embroidering, combination data set by said setting means in correspondence to this step; and needle bar drive control means for selectively coupling the main shaft to the needle bar drive mechanism thereby to enable or disable said needle bar drive mechanisms for the respective heads independently from one another in accordance with the combination data supplied by said supply means.

2. An embroidering machine as defined in claim 1 wherein said needle bar drive control means comprises a plurality of electromagnetic clutch devices each associated with a needle bar drive mechanism, each magnetic clutch being provided in a position in which rotary movement of the main shaft of the embroidering machine is transmitted to each needle bar drive mechanism, said electromagnetic clutch device corresponding to a head to be enabled being engaged and said electromagnetic clutch device corresponding to a head to be disabled being disengaged.

3. An embroidering machine as defined in claim 2 wherein said electromagnetic clutch device is provided between said main shaft and a transmitting section for receiving rotation of said main shaft and transmitting this rotation to a conversion mechanism which converts rotary motion to reciprocal motion.

4. An embroidering machine as defined in claim 1 wherein said needle bar drive control means comprises a needle bar jump mechanism for stopping a needle bar at an upper position and a jump solenoid for controlling this jump mechanism, said solenoids for the respective heads being independently energized or deenergized in response to said combination data.

5. An embroidering machine as defined in claim 1 wherein said setting means comprises memory means storing previously programmed combination data of operation/non-operation for the respective heads in correspondence to a desired one or more steps.

6. An embroidering machine as defined in claim 5 wherein said memory means comprises external memory means storing said previously programmed combination data in correspondence to said desired one or more steps and internal memory means capable of both reading and writing to which contents of storage in said external memory means are transferred.

7. An embroidering machine as defined in claim 6 which further comprises changing means for selectively changing said contents of combination data stored in said internal memory means.

8. An embroidering machine as defined in claim 7 which further comprises means for transferring the contents of said internal memory means to said external memory means for storing therein.

9. An embroidering machine as defined in claim 1 wherein said setting means comprises memory means capable of both reading and writing and write means for writing combination data of operation/non-operation for the respective heads in said memory means in correspondence to a desire one or more steps.

10. An embroidering machine as defined in claim 9 wherein said write means comprises manual data setting means for setting desired data.

11. An embroidering machine as defined in claim 1 wherein said supply means supplies said combination data in correspondence to the step of changing the color of thread.

12. An embroidering machine as defined in claim 1 wherein said supply means supplies said combination data in correspondence to the step of pattern finishing.

13. An embroidering machine as defined in claim 1 wherein said supply means comprises means for generating, in accordance with execution of an embroidering program, a head selection command in correspondence to one or more steps which have previously been programmed in said program and means for advancing a head selection step in response to this head selection command and reading out combination data set by said setting means in correspondence to the present head selection step.

14. An embroidering machine as defined in claim 1 wherein at least one of said heads comprises a multi-head type head capable of selectively driving one of a plurality of needle bars.

15. A multi-head type embroidering machine comprising:

a plurality of embroidering heads, each head having a needle bar drive mechanism;

a rotary main shaft for providing a driving force to operate the needle bar drive mechanisms;

setting means for setting a combination of heads to be in operation and heads to be out of operation in correspondence to a desired one or more steps in an embroidering process;

selection means for effecting, with respect to the combination of operation/non-operation of the respective heads set by said setting means, selection concerning change of contents of the combination independently for each head; and needle bar drive control means for selectively coupling the main shaft to the needle bar drive mechanism thereby to enable or disable the needle bar drive mechanism of each head independently in accordance with the combination set by said setting means and the result of selection by said selection means.

16. An embroidering machine as defined in claim 15 wherein said needle bar drive control means comprises read means for reading out a combination set by setting means and data formulating means for formulating operation/non-operation data selecting operation or non-operation of the respective heads by changing the combination read from said read means in accordance with a result of selection by selection means, said needle bar drive mechanism in each head being independently enabled or disabled in response to the operation/non-operation data formulated by said data formulating means.

17. An embroidering machine as defined in claim 15 wherein said selection means effects selection of operation/non-operation of the respective heads in accordance with either the combination set by said setting means, a combination which is inverse to the combination set by said setting means, a compulsory non-operation regardless of the combination or a compulsory operation regardless of contents of the combination.

18. An embroidering machine as defined in claim 15 wherein said selection means comprises a manual switch provided for each head.

* * * * *